US008840076B2

(12) United States Patent
Zuber et al.

(10) Patent No.: US 8,840,076 B2
(45) Date of Patent: Sep. 23, 2014

(54) ENHANCED SURFACE AREA FOR SIDEPLATE HEAT EXCHANGER BRACKET

(75) Inventors: Christopher L. Zuber, Royal Oak, MI (US); Timothy R. West, Livonia, MI (US); Kevin S. Bockstanz, Westland, MI (US)

(73) Assignee: DENSO International America, Inc., Southfield, MI (US)

( * ) Notice: Subject to any disclaimer, the term of this patent is extended or adjusted under 35 U.S.C. 154(b) by 32 days.

(21) Appl. No.: 13/299,963

(22) Filed: Nov. 18, 2011

(65) Prior Publication Data

US 2013/0126124 A1 May 23, 2013

(51) Int. Cl.
*F24H 9/06* (2006.01)

(52) U.S. Cl.
USPC ..... 248/232; 248/231.51; 248/300; 165/67

(58) Field of Classification Search
USPC ..... 165/67, 149; 228/183; 180/684; 24/458; 248/231.81, 300, 232
See application file for complete search history.

(56) References Cited

U.S. PATENT DOCUMENTS

| | | | | |
|---|---|---|---|---|
| 4,215,745 | A * | 8/1980 | Tuckmantel | 165/160 |
| 4,763,723 | A | 8/1988 | Granetzke | |
| 4,862,953 | A | 9/1989 | Granetzke et al. | |
| 5,139,080 | A | 8/1992 | Bolton et al. | |
| 5,183,103 | A * | 2/1993 | Tokutake | 165/67 |
| 5,348,079 | A | 9/1994 | Tanaka | |
| 5,535,819 | A | 7/1996 | Matsuura | |
| 5,605,200 | A | 2/1997 | Mayberry et al. | |
| 5,791,402 | A * | 8/1998 | Dumetz | 165/67 |
| 6,000,460 | A | 12/1999 | Yamanaka et al. | |
| 6,237,676 | B1 | 5/2001 | Hasegawa et al. | |
| 6,742,574 | B2 | 6/2004 | Sugito et al. | |
| 6,776,223 | B2 | 8/2004 | Sanada et al. | |
| 7,036,569 | B2 | 5/2006 | Kroetsch et al. | |
| 7,051,789 | B2 * | 5/2006 | Sheppard | 165/67 |
| 7,117,927 | B2 | 10/2006 | Kent et al. | |
| 8,011,420 | B2 | 9/2011 | Mazzocco et al. | |
| 2004/0094288 | A1 | 5/2004 | Hoyle | |
| 2007/0209372 | A1 | 9/2007 | Mazzocco et al. | |

* cited by examiner

*Primary Examiner* — Amy J Sterling
(74) *Attorney, Agent, or Firm* — Harness, Dickey & Pierce, P.L.C.

(57) ABSTRACT

A connecting device is used in combination with a heat exchanger. The heat exchanger has orthogonally oriented first and second mount members. The connecting device includes a body having opposed first and second sidewalls. A first sidewall extension is integrally connected to and extends orthogonally with respect to the first sidewall, and includes a first planar mount surface. A second sidewall extension is integrally connected to and extends orthogonally with respect to the second sidewall. The second sidewall extension is oppositely facing with respect to the first sidewall extension and includes a second planar mount surface. A mounting wall extension is integrally connected to and extends orthogonally with respect to the first and second sidewall extensions and includes a third planar mount surface. The first, second and third planar mount surfaces are oriented coplanar with respect to each other and are connected to the first mount member using brazing joints.

20 Claims, 6 Drawing Sheets

10
12
14
16
18
20
22
24
26
28
30
31
32
33
34
36
38
40
42
44
46
48
A
B
C
D
3

ENHANCED SURFACE AREA FOR SIDEPLATE HEAT EXCHANGER BRACKET

FIELD

The present disclosure relates to HVAC and PTC systems in vehicles including an attachment bracket brazed to a vehicle heat exchanger.

BACKGROUND

This section provides background information related to the present disclosure which is not necessarily prior art.

In automotive vehicles, heat exchangers are commonly mounted using brackets that can be fixed such as by brazing to the heat exchanger and releasably fastened using the bracket to structure of the vehicle. Due to space limitations of the vehicle, all equipment including the heat exchanger and bracket are designed to minimize their space envelope. Commonly used mounting brackets include first and second legs that are brazed to the heat exchanger in a common axis.

The surface area available for brazing can limit the structural strength provided by the brazed joints of the bracket. In addition, with the legs of the bracket each oriented in a common axis, resistance to bending in an out-of-axis plane or direction is limited, and therefore reduces the maximum retention capability of the bracket.

SUMMARY

This section provides a general summary of the disclosure, and is not a comprehensive disclosure of its full scope or all of its features.

According to several embodiments, a connecting device is provided for a heat exchanger. The heat exchanger has orthogonally oriented first and second mount members. The connecting device includes a body; a first sidewall extension integrally connected to and extending from the body and including a first planar mount surface; and a second sidewall extension integrally connected to and extending from the body. The second sidewall extension oppositely faces with respect to the first sidewall extension and includes a second planar mount surface. A mounting wall extension is integrally connected to the body and extends orthogonally with respect to the first and second sidewall extensions and includes a third planar mount surface. The first, second and third planar mount surfaces are oriented parallel to each other and are fixedly connected to the first mount member.

According to further embodiments, a connecting device is provided for combination use with a heat exchanger. The heat exchanger has orthogonally oriented first and second mount members. The connecting device includes a body having opposed first and second sidewalls. A first sidewall extension is integrally connected to and extends orthogonally with respect to the first sidewall, and includes a first planar mount surface. A second sidewall extension is integrally connected to and extends orthogonally with respect to the second sidewall. The second sidewall extension oppositely faces with respect to the first sidewall extension and includes a second planar mount surface. A mounting wall extension is integrally connected to the body and extends orthogonally with respect to the first and second sidewall extensions, and includes a third planar mount surface. The first, second and third planar mount surfaces are oriented parallel to each other.

According to other embodiments of the connecting device provided for combination use with a heat exchanger, the first and second sidewall extensions are oriented with respect to a longitudinal axis of the first mount member thereby increasing a longitudinal stiffness of the connecting device. The mounting wall extension has a longitudinal axis oriented orthogonal with respect to the longitudinal axis of the first mount member thereby increasing a lateral stiffness of the connecting device.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figures 1, 2, 3:
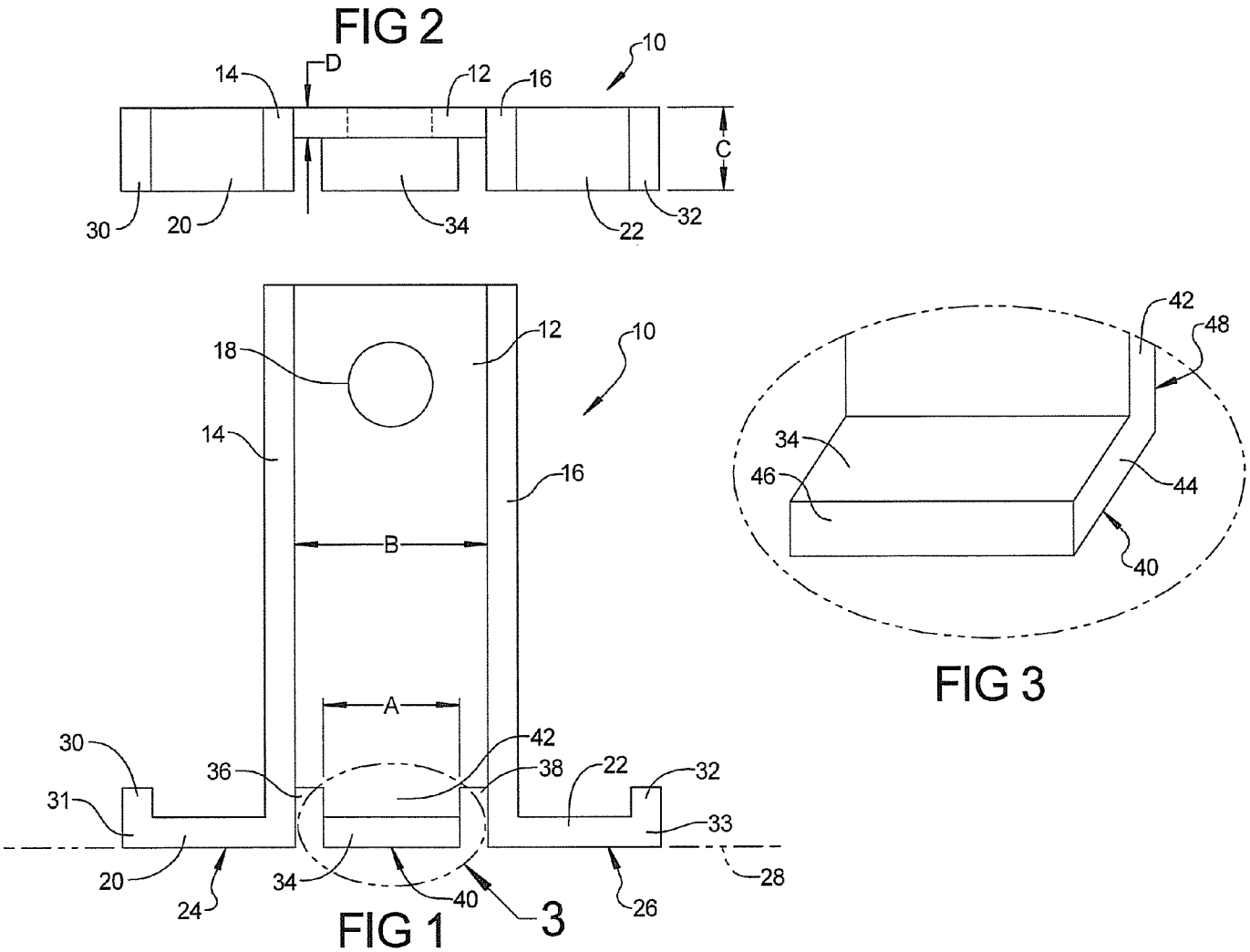
FIG. 1 is a front elevational view of a bracket of the present disclosure.
FIG. 2 is a top plan view of the bracket of FIG. 1.
FIG. 3 is a front left perspective view of area 3 of FIG. 1.

Referring to FIG. 1, a bracket or connecting device 10 includes a planar body portion 12 having integrally connected and extending first and second sidewalls 14, 16. First and second sidewalls 14, 16 are oriented orthogonally with respect to the planar body portion 12 and therefore act to longitudinally and laterally stiffen the planar body portion 12. In addition, first and second sidewalls 14, 16 are configured parallel to each other and can be formed for example by bending material of planar body portion 12. The planar body portion 12 can further include at least one aperture 18 which is sized to receive a fastener (not shown) used to connect the planar body portion 12 to an additional component (not shown).

Integrally connected to and extending orthogonally with respect to the first and second sidewalls 14, 16 are each of a first sidewall extension 20 and an oppositely directed second sidewall extension 22. First sidewall extension 20 defines a first planar mount surface 24, and second sidewall extension 22 similarly defines a second planar mount surface 26. According to several embodiments, the first and second planar mount surfaces 24, 26 are both oriented parallel with respect to each other and coplanar with respect to a planar surface 28. In order to stiffen each of the first and second sidewall extensions 20, 22, a first stiffening member 30 which is oriented parallel to first sidewall 14 and therefore orthogonally with respect to first sidewall extension 20 can be integrally included with and extend from a free end 31 of first sidewall extension 20. Similarly, a second stiffening member 32 oriented parallel with respect to second sidewall 16 can be integrally provided with and extend from a free end 33 second sidewall extension 22. Both first and second stiffening members 30, 32 are directed oppositely with respect to the first and second planar mount surfaces 24, 26.

In addition to the first and second sidewall extensions 20, 22, connecting device 10 can further include a mounting wall extension 34 which is created by removing material of planar body portion 12 defining first and second relief notches 36, 38 in planar body portion 12. Mounting wall extension 34 includes a third planar mount surface 40 which is oriented parallel with respect to both first and second planar mount surfaces 24, 26 and also coplanar with respect to planar surface 28. The mounting wall extension 34 has an extension width "A" which is less than a body portion width "B" of the planar body portion 12. Mounting wall extension 34 is an integrally extending portion of a mounting wall base 42 created from material of planar body portion 12, which is positioned between each of the first and second relief notches 36, 38.

Referring to FIG. 2, the first and second stiffening members 30, 32, the first and second sidewalls 14, 16, and the first and second sidewall extensions 20, 22 each share a common device depth "C". The planar body portion 12 defines a portion of device depth "C", and according to several embodiments has a body portion thickness "D".

Referring to FIG. 3, according to several embodiments, the mounting wall extension 34 defines an L-shape having a mounting wall side surface 44 oriented orthogonally with respect to mounting wall base 42. A mounting wall front surface 46 is oriented parallel with respect to planar body portion 12. Oppositely directed with respect to mounting wall front surface 46 is a fourth planar mount surface 48 which is orthogonally oriented with respect to planar surface 28 and is therefore also oriented parallel with respect to planar body portion 12. Mounting wall extension 34 can be formed for example in a bending or breaking operation from the material of mounting wall base 42.

Figure 4:
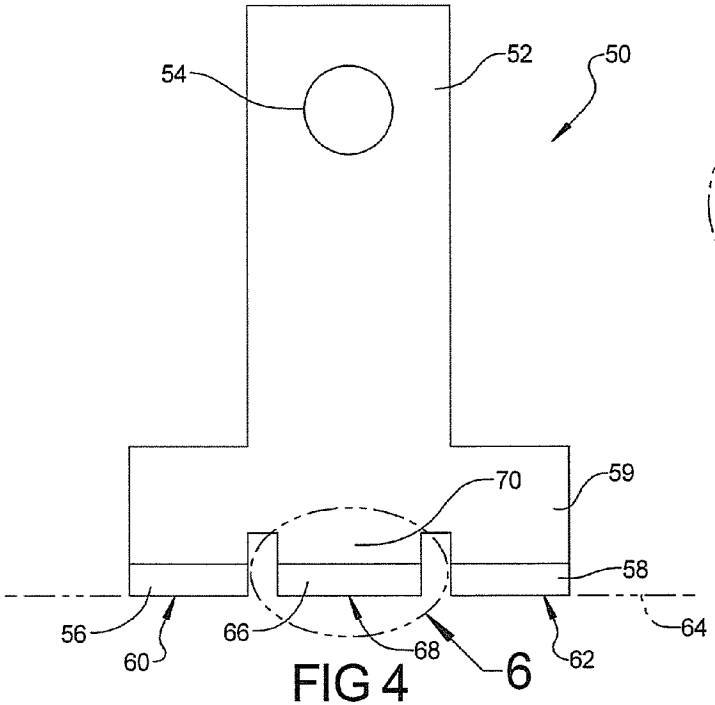
FIG. 4 is a front elevational view of another embodiment for a bracket of the present disclosure.

Referring to FIG. 4 and again to FIGS. 1-3, a bracket or connecting device 50 is modified with respect to connecting device 10 to eliminate the first and second sidewalls 14, 16 and further to eliminate the first and second stiffening members 30, 32. Connecting device 50 therefore includes a planar body portion 52 having an aperture 54 created therethrough. A first sidewall extension 56 and a second sidewall extension 58 both extend orthogonally with respect to a lower body portion 59 of planar body portion 52. The first sidewall extension 56 includes a first planar mount surface 60 and the second sidewall extension 58 includes a second planar mount surface 62. Each of the first and second planar mount surfaces 60, 62 are oriented parallel with respect to each other and are also oriented coplanar with respect to a planar surface 64. Similar to mounting wall extension 34, connecting device 50 includes a mounting wall extension 66 which defines a third planar mount surface 68. Third planar mount surface 68 is oriented parallel with respect to first and second planar mount surfaces 60, 62 and is also oriented coplanar with respect to planar surface 64. Mounting wall extension 66 integrally extends from a mounting wall base 70 which is created from notches similar to first and second relief notches 36, 38 of connecting device 10.

Figure 5:
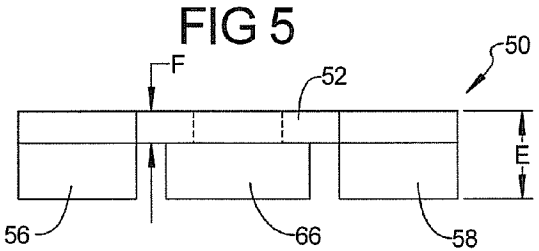
FIG. 5 is a top plan view of the bracket of FIG. 4.

Referring to FIG. 5 and again to FIG. 2, connecting device 50, similar to connecting device 10, has an overall device width "E" which includes a body portion thickness "F" of planar body portion 52 and portions of each of the first and second sidewall extensions 56, 58 and mounting wall extension 66.

Figure 6:
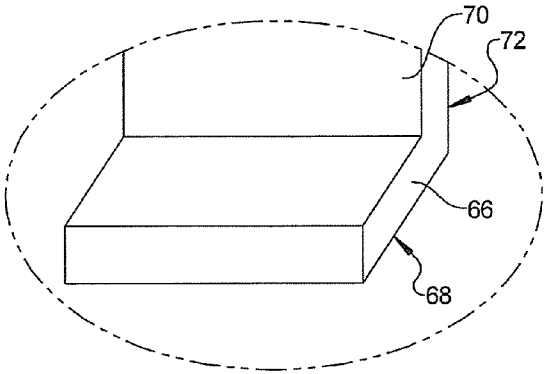
FIG. 6 is a front left perspective view of area 6 of FIG. 4.

Referring to FIG. 6, the mounting wall extension 66 defines a substantially L-shape when viewed with respect to mounting wall base 70. In addition to third planar mount surface 68, the mounting wall base 70 further includes a fourth planar mount surface 72 which is oriented orthogonally with respect to third planar mount surface 68 and parallel with respect to planar body portion 52.

Figure 7:
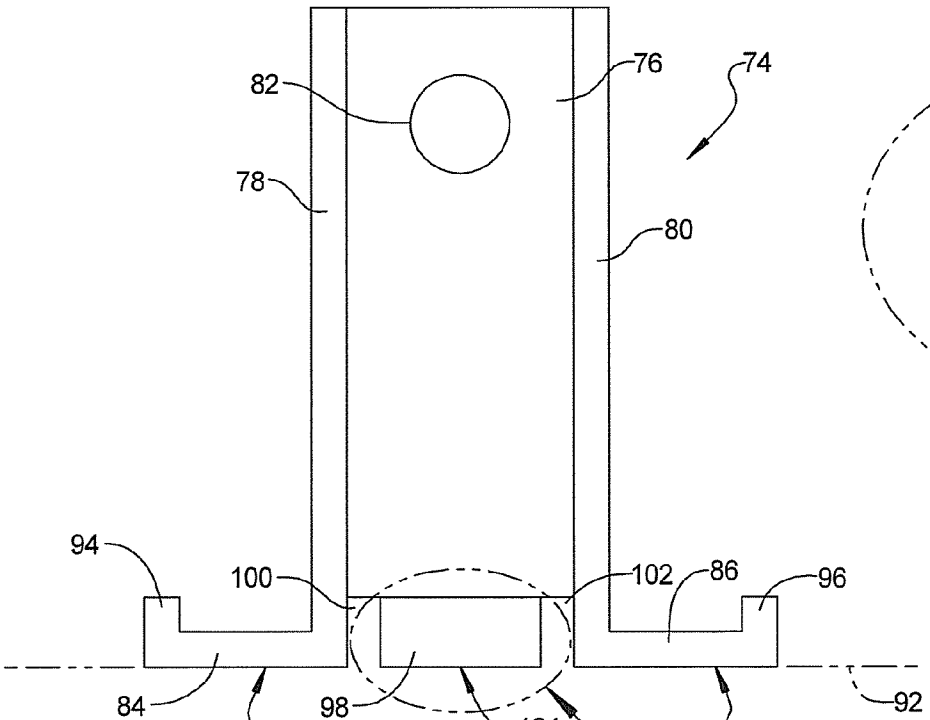
FIG. 7 is a front elevational view of a further embodiment of a bracket of the present disclosure.

Referring to FIG. 7 and again to FIGS. 1-6, a bracket or connecting device 74 is similar to both connecting devices 10 and 50 but includes a modified mounting wall extension. Connecting device 74 includes a planar body portion 76 having parallel first and second sidewalls 78, 80 which are oriented orthogonally with respect to planar body portion 76 and are therefore similarly configured with respect to first and second sidewalls 14, 16. An aperture 82 can also be included through planar body portion 76 similar to apertures 18, 54. Connecting device 74 further includes first and second sidewall extensions 84, 86 which are similarly formed and similarly oriented with respect to first and second sidewall extensions 20, 22 and first and second sidewall extensions 56, 58. First and second planar mount surfaces 88, 90 are defined by the first and second sidewall extensions 84, 86. The first and second planar mount surfaces 88, 90 are parallel with respect to each other and are oriented coplanar with respect to a planar surface 92.

Similar to the first and second stiffening members 30, 32 of connecting device 10, connecting device 74 can also include first and second stiffening members 94, 96 integrally connected to and extending parallel with respect to first and second sidewalls 78, 80. A mounting wall extension 98 is modified with respect to the mounting wall extensions 34, 66 of connecting devices 10, 50. Mounting wall extension 98 is created between first and second sidewalls 78, 80 and is separated from planar body portion 76 by first and second relief notches 100, 102. Mounting wall extension 98 includes a third planar mount surface 104 which is oriented parallel with respect to first and second planar mount surfaces 88, 90 and is also oriented coplanar with respect to planar surface 92.

Figure 8:
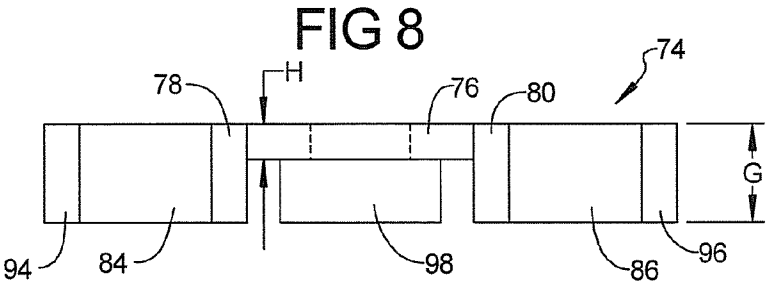
FIG. 8 is a top plan view of the bracket of FIG. 7.

Referring to FIG. 8, connecting device 74 has a device width "G" which is defined by the first and second stiffening members 94, 96, first and second sidewall extensions 84, 86, and first and second sidewalls 78, 80. A body portion thickness "H" of planar body portion 76 defines a portion of device width "G" and mounting wall extension 98 extends for a total width of device width "G".

Figure 9:
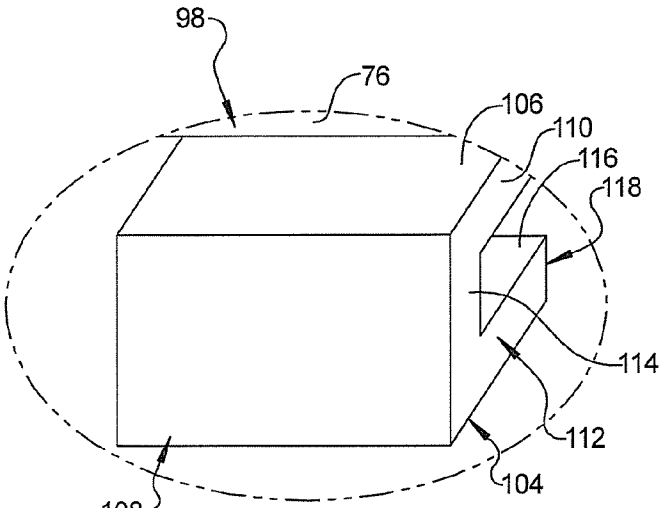
FIG. 9 is a front left perspective view of area 9 of FIG. 7.

Referring to FIG. 9, mounting wall extension 98 can be formed for example by a bending or breaking operation in the material originally extending with respect to planar body portion 76. Mounting wall extension 98 includes an extension upper surface 106 which is orthogonally oriented with respect to planar body portion 76. An extension end surface 108 defines a free end of extension upper surface 106 and is oriented orthogonally with respect to extension upper surface 106. A third planar mount surface 104 is oriented parallel to and faces oppositely with respect to extension upper surface 106. According to several embodiments, mounting wall extension 98 defines a substantially U-shaped member having an extension upper wall 110, an extension lower wall 112 oriented parallel with respect to extension upper wall 110, and an extension first end wall 114 which includes extension end surface 108 such that extension first end wall 114 is oriented orthogonally with respect to extension upper and lower walls 110, 112. A U-shaped cavity 116 is therefore defined between extension upper and lower walls 110, 112 and extension first end wall 114. An extension second end surface 118 is defined at a free end of extension lower wall 112 and is oriented parallel with respect to extension end surface 108.

Referring to FIG. 10 and again to FIGS. 1-9, a connecting device assembly 120 includes a bracket or connecting device 122 which is modified with respect to the connecting devices 10, 50, 74 previously described herein. Connecting device 122 is fixed to a component 124, such as a heat exchanger body, by brazing. Component 124 includes a component first mount member 126 which defines a substantially planar component first mount surface 128. Component 124 further includes a component second mount member 130 which is oriented orthogonally with respect to component first mount member 126. Component second mount member 130 includes a component second mount surface 132 which defines a substantially planar surface orthogonally oriented with respect to component first mount surface 128.

Connecting device 122 includes a body 134 having an elongated aperture 135 and a first sidewall 136 with an integrally extending first sidewall extension 138 oriented parallel and substantially coplanar with respect to component first mount surface 128, thereby permitting a first brazed joint 140 to be created between first sidewall extension 138 and component first mount surface 128. Similarly, body 134 also includes a second sidewall 142 having a second sidewall extension 144 integrally extending therefrom oppositely directed with respect to first sidewall extension 138. Second sidewall extension 144 is oriented parallel to and substantially coplanar with respect to component first mount surface 128. A second brazed joint 146 is created between second sidewall extension 144 and component first mount surface 128. The first and second sidewall extensions 138, 144 increase a longitudinal stiffness of connecting device 122 against longitudinal bending of body 134 with respect to a longitudinal axis "J" of first mount member 126. Each of the first and second sidewall extensions 20, 22; 56, 58; and 84, 86 provide similar improvements to the longitudinal stiffness of the corresponding connecting devices 10, 50 and 74.

In order to further enhance the stability of connecting device 122 when fixed to component 124, a mounting wall base 148 is further provided, having an integrally connected mounting wall extension 150. Mounting wall extension 150 is substantially coplanar with respect to component first mount surface 128, but is oriented with respect to a longitudinal axis "K" which is oriented orthogonal to longitudinal axis "J". Mounting wall extension 150 provides for a third brazed joint 152 between mounting wall extension 150 and component first mount surface 128. Because the mounting wall extension 150 is oriented orthogonally with respect to first and second sidewall extensions 138, 144, mounting wall extension 150 increases a lateral stiffness of connecting device 122 with respect to a bending force acting parallel to longitudinal axis "K" of mounting wall extension 150. Each of the mounting wall bases 34, 66 and 98 provide similar improvements to the lateral stiffness of the corresponding connecting devices 10, 50 and 74.

To further improve the lateral stability of connecting device 122, a fourth brazed joint 154 can be provided between a rear facing surface (not shown in this view) of mounting wall base 148 and a portion of the component second mount surface 132. This additional fourth brazed joint 154 therefore allows for connectivity between connecting device 122 and component 124 for a full width "L" of component first mount surface 128 with respect to first, second and third brazed joints 140, 146, 152 as well as a full width or height "M" of component second mount surface 132 with respect to fourth brazed joint 154.

Figure 11:
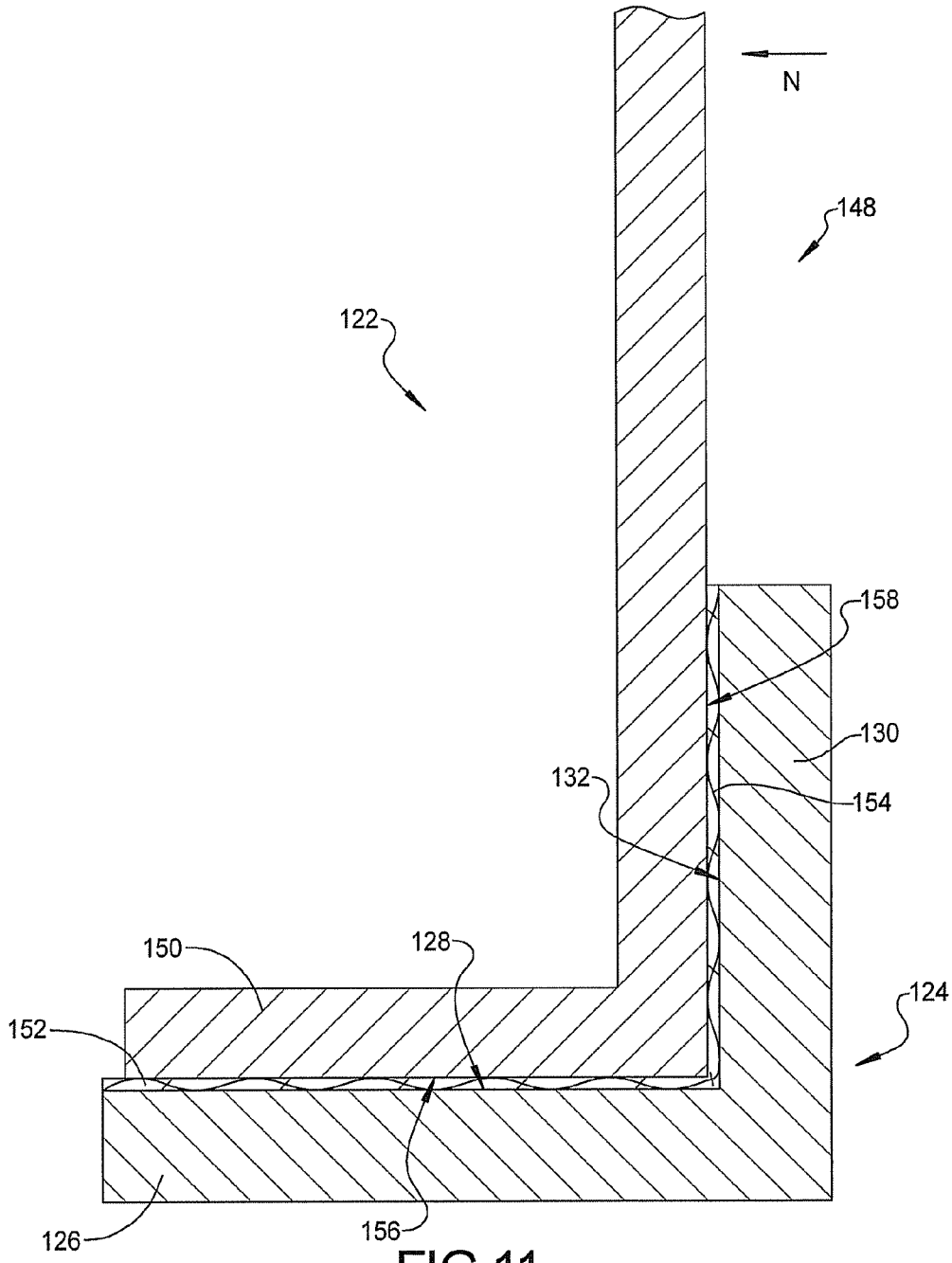
FIG. 11 is a partial cross sectional end elevational view at section 11 of FIG. 10.

Referring to FIG. 11, connecting devices of the present disclosure can include the fourth brazed joint such as fourth brazed 154 to further enhance lateral stability of the connecting device to component connection. With the mounting wall extension 150 positioned having a third planar mount surface 156 facing first mount surface 128 of first mount member 126, the third brazed joint 152 is created. Third brazed joint 152 can be supplemented by addition of fourth brazed 154, which is created between a fourth planar mount surface 158 of mounting wall base 148 and component second mount surface 132 of component second mount member 130. Fourth brazed joint 154, as well as third brazed joint 152, increase the lateral stability of connecting device 122, particularly when a lateral load is applied to connecting device 122 in a load direction "N".

Figure 10:
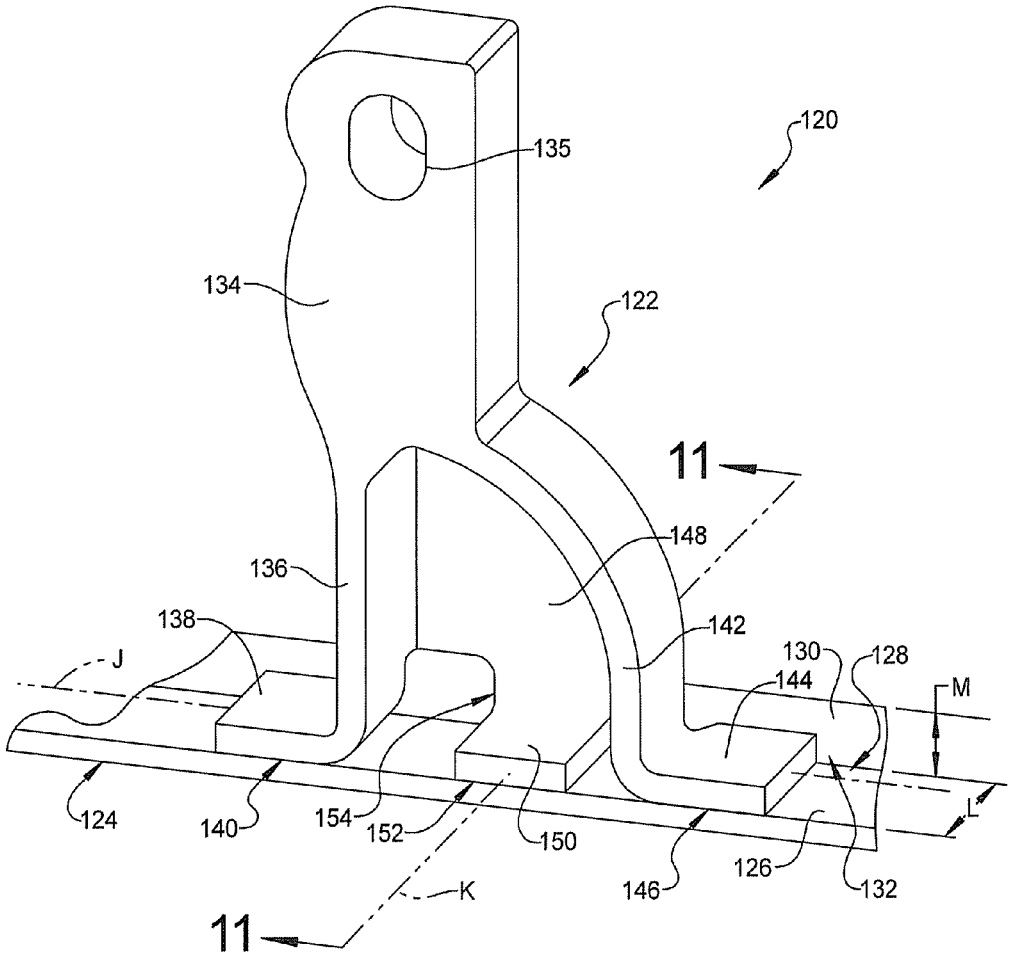
FIG. 10 is a front left perspective view of a bracket of the present disclosure brazed to a component.
Figure 12:
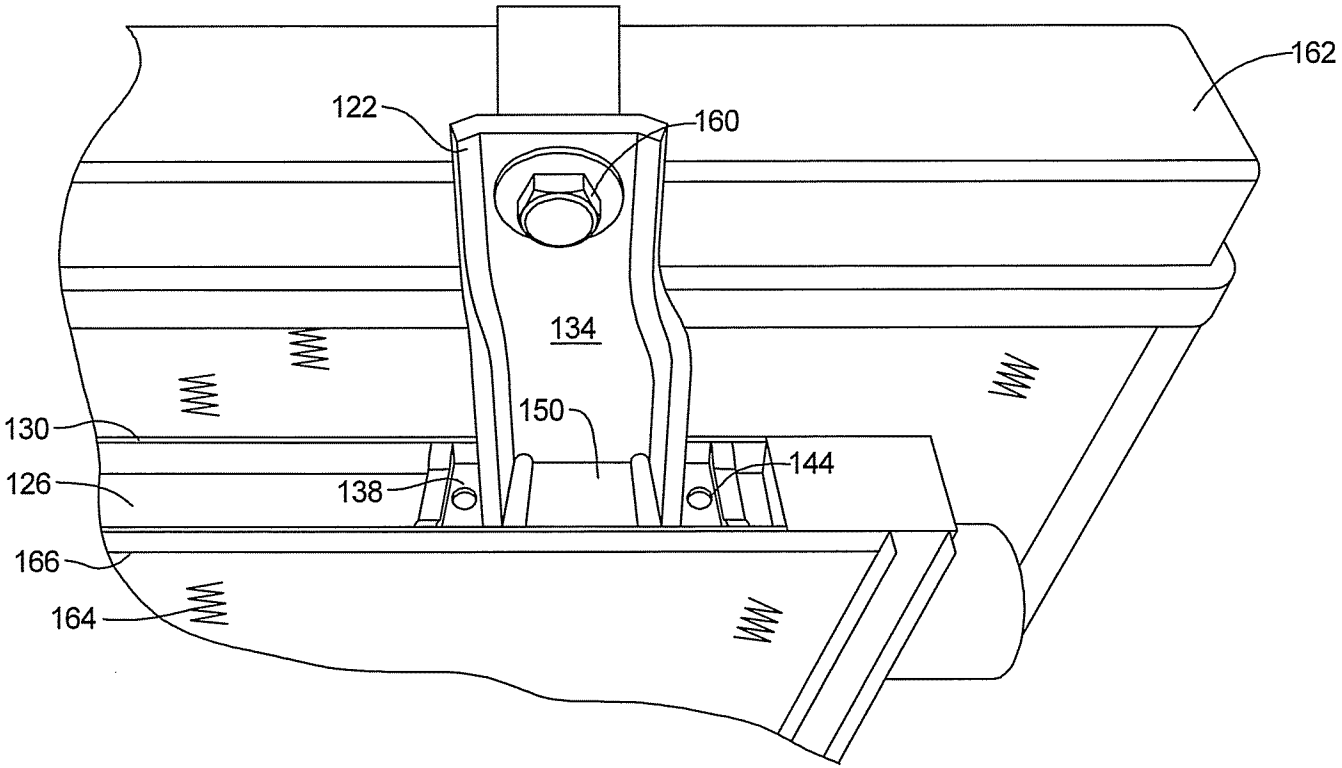
FIG. 12 is a top perspective view of an exemplary automobile vehicle engine compartment arrangement having a bracket/connecting device of the present disclosure positioned for retaining a cooler-condenser heat exchanger.

Referring to FIG. 12 and again to FIGS. 10-11, connecting device 122 shown in a modified embodiment is depicted in use having a fastener 160 such as a bolt received in elongated aperture 135 of body 134 to couple a first heat exchanger 162 such as a radiator to a second heat exchanger 164 such as an HVAC heat exchanger substituted for component 124. Mounting wall extension 150 and each of first and second side wall extensions 138, 144 are received in component first mount member 126 of second heat exchanger 164 between component second mount member 130 and an opposed component third mount member 166 of second heat exchanger 164. The mounting wall extension 150 and each of the first and second side wall extensions 138, 144 are brazed to component first mount member 126 of second heat exchanger 164, and a portion of the fourth planar mount surface 158 is brazed to component second mount member 130 to secure connecting device 122 to second heat exchanger 164.

With continuing reference to FIG. 10, and again to FIGS. 1-9, any of the connecting devices 10, 50 or 74 can also be substituted in the configuration shown and described with respect to FIG. 10. For example, connecting device 10 connected to component 124 would include the first and second planar mount surfaces 24, 26 as well as the third planar mount surface 40 brazed with respect to component first mount surface 128. Further, either the mounting wall front surface 46 or fourth planar mount surface 48 of connecting device 10 can be brazed to component second mount surface 132. Similarly, if connecting device 50 is connected to component 124, each of the first and second planar mount surfaces 60, 62, as well as third planar mount surface 68, can be brazed to component first mount surface 128. The fourth planar mount surface 72 of connecting device 50 can be brazed to component second mount surface 132.

When connecting device 74 is substituted for connecting device 122 with respect to the arrangement shown in FIG. 10, each of the first, second, and third planar mount surfaces 88, 90, 104 are brazed to component first mount surface 128. The arrangement of connecting device 74 further allows either the extension end surface 108 or the extension second end surface 118 to be brazed to component second mount surface 132, depending upon the rotational orientation of connecting device 74. Connecting device 74 provides the enhanced surface area of extension end surface 108 for increased surface area contact with component second mount surface 132. According to several embodiments, extension end surface 108 can be sized to substantially match the height "K" of component second mount surface 132.

Although brazed joints are described herein, these joints can be replaced by welded joints, soldered joints, or similar fixed connections. Connecting devices of the present disclosure provide a third surface area for brazing, welding or soldering with respect to a component. In addition, each of the connecting devices of the present disclosure also permit the brazing or fixing of an orthogonally oriented portion or surface of the connecting device to a second mount surface of a component. The increased quantity of mounting surfaces, the orientation of the mounting surfaces, and the addition of an orthogonally oriented mounting surface for the connecting devices of the present disclosure therefore substantially improve the lateral stability of the connecting device with respect to a component.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A connecting device in combination with a heat exchanger, the heat exchanger having orthogonally oriented first and second mount members, the connecting device comprising:

a body;

a first sidewall extension integrally connected to and extending from the body and including a first planar mount surface;

a second sidewall extension integrally connected to and extending from the body, the second sidewall extension oppositely facing with respect to the first sidewall extension and including a second planar mount surface; and a mounting wall extension integrally connected to the body and extending orthogonally with respect to the first and second sidewall extensions and including a third planar mount surface, the first, second and third planar mount surfaces oriented coplanar to each other and generally perpendicular to the body, the first, second and third planar mount surfaces being fixedly connected to the first mount member; wherein the body is a U-shaped member extending away from the first mount member of the heat exchanger in a direction perpendicular to the first, second and third planar mount surface.

2. The combination of claim 1, wherein each of the first, second and third planar mount surfaces are oriented coplanar with respect to the first mount member of the heat exchanger.

3. The combination of claim 2, wherein a connecting device assembly is created when the connecting device is fixedly connected to the heat exchanger by a brazed joint created individually between each of the first, second and third planar mount surfaces and the first mount member of the heat exchanger.

4. The combination of claim 1, wherein the mounting wall extension includes extension upper and lower surfaces and an extension first end wall joining the extension upper and lower surfaces, the upper and lower surfaces and the extension first end wall together defining a U-shape, the extension lower surface including the third planar mount surface.

5. The combination of claim 4, wherein the extension first end wall includes an extension end surface defining a fourth planar mount surface oriented orthogonally with respect to the first, second and third planar mount surfaces.

6. The combination of claim 5, further including:

first, second and third brazed joints created individually between each of the first, second and third planar mount surfaces and the first mount member of the heat exchanger; and a fourth brazed joint fixedly connecting the fourth planar mount surface to the second mount member of the heat exchanger.

7. The combination of claim 1, wherein the body is planar and includes first and second sidewalls oriented parallel with respect to each other and oriented orthogonal with respect to the body, the first sidewall extension oriented orthogonal with respect to the first sidewall and the second sidewall extension oriented orthogonal with respect to the second sidewall.

8. The combination of claim 7, further including a first stiffening member extending integrally from a free end of the first sidewall extension and a second stiffening member extending integrally from a free end of the second sidewall extension, the first and second stiffening members oriented parallel to the first and second sidewalls.

9. The combination of claim 1, wherein the mounting wall extension includes a mounting wall base integrally connected to the body, the mounting wall extension and the mounting wall base defining an L-shape.

10. The combination of claim 1, wherein:

the first and second sidewall extensions are oriented with respect to a longitudinal axis of the heat exchanger first mount member increasing a longitudinal stiffness of the connecting device; and the mounting wall extension having a longitudinal axis oriented orthogonal with respect to the longitudinal axis of the first mount member increasing a lateral stiffness of the connecting device.

11. A connecting device in combination with a heat exchanger, the heat exchanger having orthogonally oriented first and second mount members, the connecting device comprising:

a body having opposed first and second sidewalls;

a first sidewall extension integrally connected to and extending orthogonally with respect to the first sidewall, and including a first planar mount surface;

a second sidewall extension integrally connected to the body and extending orthogonally with respect to the second sidewall, the second sidewall extension oppositely facing with respect to the first sidewall extension and including a second planar mount surface; and a mounting wall extension integrally connected to the body and extending orthogonally with respect to the first and second sidewall extensions, and including a third planar mount surface, the first, second and third planar mount surfaces oriented coplanar to each other and generally perpendicular to the body; wherein the body is a U-shaped member extending away from the first mount member of the heat exchanger in a direction perpendicular to the first, second and third planar mount surface.

12. The combination of claim 11, further including a first stiffening member extending integrally from a free end of the first sidewall extension and a second stiffening member extending integrally from a free end of the second sidewall extension.

13. The combination of claim 12, wherein the first and second stiffening members are oriented parallel to the first and second sidewalls.

14. The combination of claim 12, wherein the first and second stiffening members are directed oppositely with respect to the first and second planar mount surfaces.

15. The combination of claim 11, wherein the mounting wall extension is created by removing material of the planar body portion thereby defining first and second relief notches in the planar body portion.

16. The combination of claim 1, wherein the first planar mount surface is completely separated from the second and third mount surfaces by a first open gap, and the second planar mount surface is completely separated from the third mount surface by a second open gap.

17. The combination of claim 1, wherein the first, second and third planar mount surfaces are completely separate from each other without having an interconnecting planar surface between any two of the first, second and third planar mount surfaces.

18. The combination of claim 11, wherein the first planar mount surface is completely separated from the second and third mount surfaces by a first open gap, and the second planar mount surface is completely separated from the third mount surface by a second open gap.

19. The combination of claim 11, wherein the first, second and third planar mount surfaces are completely separate from each other without having an interconnecting planar surface between any two of the first, second and third planar mount surfaces.

20. A connecting device in combination with a heat exchanger, the heat exchanger having orthogonally oriented first and second mount members, the connecting device comprising:

a body;

a first sidewall extension integrally connected to and extending from the body and including a first planar mount surface;

a second sidewall extension integrally connected to and extending from the body, the second sidewall extension oppositely facing with respect to the first sidewall extension and including a second planar mount surface; and a mounting wall extension integrally connected to the body and extending orthogonally with respect to the first and second sidewall extensions and including a third planar mount surface, the first, second and third planar mount surfaces oriented coplanar to each other and generally perpendicular to the body, the first, second and third planar mount surfaces being fixedly connected to the first mount member;

the first planar mount surface is completely separated from the second and third mount surfaces by a first open gap, and the second planar mount surface is completely separated from the third mount surface by a second open gap.

* * * * *